US006083288A

United States Patent [19]

Wolf

[11] Patent Number: 6,083,288

[45] Date of Patent: Jul. 4, 2000

[54] FUEL STABILIZERS

[75] Inventor: Leslie R. Wolf, Naperville, Ill.

[73] Assignee: BP Amoco Corporation, Chicago, Ill.

[21] Appl. No.: 09/111,020

[22] Filed: Jul. 7, 1998

Related U.S. Application Data

[60] Provisional application No. 60/052,461, Jul. 14, 1997.

[51] Int. Cl.[7] ..... C10L 1/22

[52] U.S. Cl. ..... 44/342; 44/421; 44/450; 252/188.2 B; 252/390

[58] Field of Search ..... 44/342, 421, 450; 252/188.2 B, 390

[56] References Cited

U.S. PATENT DOCUMENTS

| | | | |
|---|---|---|---|
| 2,533,205 | 12/1950 | Chenicek | 44/421 |
| 2,754,216 | 7/1956 | Chenicek | 44/421 |
| 3,033,664 | 5/1962 | Pethrick | 44/342 |
| 3,036,902 | 5/1962 | Hamer | 44/342 |
| 3,043,783 | 7/1962 | Hatcher | 44/421 |
| 3,071,451 | 1/1963 | Schmerling | 44/421 |
| 3,927,995 | 12/1975 | Romans | 44/342 |
| 4,775,458 | 10/1988 | Forester | 208/48 AA |
| 5,575,823 | 11/1996 | Wallace et al. | 44/359 |

*Primary Examiner*—Jacqueline V. Howard
*Assistant Examiner*—Cephia D. Toomer
*Attorney, Agent, or Firm*—Richard A. Kretchmer; Frank J. Sroka

[57] ABSTRACT

A strongly basic, hydrophobic amine which prevents the deposition of fuel-insoluble carboxylate deposits in fuel tanks and fuel transfer equipment is contained in a fuel additive package which minimizes the degradation of a hydrocarbon fuel during storage.

26 Claims, No Drawings

FUEL STABILIZERS

CROSS REFERENCE TO RELATED APPLICATIONS

This application claims the benefit of the U.S. Provisional Application filed by Leslie R. Wolf, Ser. No. 60/052,461 filed Jul. 14, 1997.

FIELD OF THE INVENTION

This invention relates to additives for hydrocarbon fuels. In one aspect it relates to additives for hydrocarbon fuels which minimize the degradation of the hydrocarbon fuels upon storage. In another aspect it relates to additive-containing hydrocarbon fuels which maintain their stability during long term storage of the fuels.

BACKGROUND OF THE INVENTION

After new automobiles, trucks and motor vehicles, in general, are assembled, their fuel tanks are generally filled to some extent with an appropriate fuel before the vehicles are shipped to their point of sale and delivery to the ultimate customer. Because of the global nature of the motor vehicle industry, with the assembly of the vehicles often times taking place in a different part of the world relative to the point of sale of the vehicle, the fuel that is placed in these fuel tanks often stands unused for extended periods of time during shipment and storage of the vehicles. During these periods of time, the fuel in the fuel tanks, now effectively being in storage, must retain its initial integrity and not degrade with the degradation exhibiting itself through subsequent starting and running problems in the new vehicle and also by the formation of undesirable deposits in the fuel systems of the vehicles leading to longer term operability problems. The fuel so used must resist gum and sediment formation, minimize oxidation and prevent corrosion in the metallic portions of the fuel system as well as passivate fresh metal surfaces. Likewise, the fuel storage facilities, for example, tankage, pumps and plumbing, at the motor vehicle assembly site are also susceptible to the deposition of these unwanted solid materials from the quantities of stored motor fuels awaiting transfer to the newly-assembled vehicles.

The desired stability of the fuel is usually attained through the addition of appropriate additives to the fresh fuel. Typically, complex combinations of antioxidants, such as aromatic diamines or hindered phenols, carboxylic acid-based corrosion inhibitors, and metallic ion sequesterants such as salicyclidene diamines are added as a stability-inducing package to the fuel. The term "package" is used typically to indicate the complex combination of the various stability-inducing materials often times diluted with a solvent or solvents compatible with the various individual additive materials and the fuel to be treated. This package is generally prepared as a separate entity prior to its addition to the fuel.

If such a stability-inducing additive package is not employed, spontaneous deposition of undesirable deposits of solid, insoluble materials often occurs in the fuel tanks and systems of the new vehicles. These deposits, also referred to as gum, are mainly formed from oxidized and/or polymerized hydrocarbons. If a stability-inducing additive package is employed, gum formation in new vehicles can be reduced or eliminated. However, stability-inducing additive packages that employ carboxylic acid-based corrosion inhibitors and salicylidene diamine sequesterants can lead to the formation of solid, insoluble deposits in the fuel storage and transfer apparatus of the vehicle manufacturing plant. These deposits are mainly hydrophilic carboxylate salts of metal ions arising from corrosion in the fuel storage and transfer systems and also of carboxylate salts of diamine impurities typically found in the salicyclidene diamine sequesterants. These carboxylate salts are virtually insoluble in the hydrocarbon fuel media and, as such, can also be deposited at various points throughout the fuel systems of the newly-manufactured vehicles in question.

In attempts to stabilize motor fuel toward oxidative degradation, it is often times found that sufficient oxidative stability is not imparted to the fuel by the use of a single antioxidant material. Hence, more than one specific oxidation-stabilizing material can be added to the fresh fuel to provide for the desired level of oxidative stability.

SUMMARY OF THE INVENTION

One object of the present invention is to provide a stability-enhancing additive which can be added to a hydrocarbon fuel and which minimizes solid deposit and gum formation upon storage of the fuel. Another object of the invention is to provide a hydrocarbon fuel stability-enhancing additive which does not contain a carboxylic acid or carboxylic acid derivative. A further object of the invention is to provide a hydrocarbon fuel stability-enhancing additive which contains a strongly basic, hydrophobic amine. A still further object of the invention is to provide a hydrocarbon fuel with enhanced stability toward oxidation and solid deposit formation during storage. These objects will be attainable through the use of the invention as described below.

This invention provides for a corrosion inhibitor, as an additive for hydrocarbon fuels, which comprises a strongly basic, hydrophobic high molecular weight organoamine, or a mixture of such amines, drawn from the group consisting of amidine, mono-substituted amidines and multiply-substituted amidines of generalized formula:

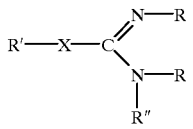

where

R = —H or [—(CH2—CH2)—]$_{1/2}$

X = —$CH_2$— or —NH—,

R' = a hydrocarbon radical containing at least 11 and no more than 24 carbon atoms, and R" = —H, an alkyl hydrocarbon radical containing no more than 5 carbon atoms, or a hydroxyalkyl hydrocarbon radical containing no more than 5 carbon atoms.

Because this corrosion inhibitor is not a carboxylic acid or a derivative of a carboxylic acid, the formation of carboxylate salts in the fuel is precluded eliminating the precipitation of hydrocarbon-insoluble carboxylate salts as solid deposits in fuel storage tanks, fuel transfer equipment or vehicle fuel systems. In addition, because the corrosion inhibitor is hydrophobic, and thereby organophilic, any such carboxylate salt which might, in fact, form from the amine and any carboxylic acid or carboxylic acid derivative already present in the hydrocarbon fuel to be treated would remain solubilized and not form undesirable insoluble deposits.

In addition, because the corrosion inhibitor is strongly basic, any carboxylate salt which might form by the interaction of a carboxylic acid or carboxylic acid derivative initially present in the fuel with a less basic amine or amines added intentionally or inadvertently with other components of the overall additive package, as described below, are immediately converted to the corresponding organophilic, protonated strongly-basic amidinium or substituted amidinium salt and remain soluble in the hydrocarbon fuel.

This invention also uses a combination of a N,N'-dialkyl-p-phenylene diamine and butylated phenols as stabilizers toward hydrocarbon oxidation. This combination provides for good oxidative stability for virtually all types of hydrocarbon fuels.

In addition, this invention includes a standard type of metal deactivator, namely, a salicylidene diamine, to passivate fresh metal surfaces of the fuel storage vessels and tanks, and the fuel transfer apparatus and to sequester oxidation-promoting metal ions which may be in the fuel.

The present invention employs a mixture of aromatic and alcoholic solvents to solubilize the components of the additive package and to facilitate the handling and addition of the additive package in concentrations convenient and appropriate for addition to the hydrocarbon fuel.

Additionally, this invention includes a fuel composition, typically, but not limited to, a motor gasoline, to which the additive package comprising the above described components has been added and which exhibits enhanced stability, especially toward solid deposit formation, during storage.

DETAILED DESCRIPTION OF THE PREFERRED EMBODIMENT

Fuel stabilization additive packages are typically utilized by adding an amount of the package to fresh fuel such that the resulting fuel shows no deleterious stability problems over a time period at least as long as the anticipated storage period. Thus, the fuel stabilization package of the present invention is added to fresh fuel, typically, motor gasoline, at the rate of from 0.25 gallon to 1.0 gallon of additive package per 1000 gallons of the fresh fuel. In this invention, a preferred blending ratio is 0.5 gallon of the additive package per 1000 gallons of the fresh fuel.

The fuel additive package of this invention comprises a combination of stability-enhancing active ingredients added to inert carrier ingredients. Typically, the concentration of the active ingredients ranges from 13 weight percent to 78 weight percent of the final additive package composition with the inert carrier components concentration ranging from 87 weight percent to 22 weight percent, respectively. Preferably, the active ingredients represent 26 weight percent of the additive package with the inert carrier components representing the remaining 74 weight percent.

The inert components of the additive package comprise a mixture of aromatic hydrocarbons and alcoholic solvents that effectively solubilize the stability-enhancing active components of the package while at the same time exhibit high solubility in the fuel to be treated. Constraints of cost, compatibility with combustion processes, purity and their own long-term stabilities must be considered when choosing the inert carrier components. It has been found that mixtures of the various isomers of xylene can function as one inert component while a simple aliphatic alcohol, namely 2-propanol, often referred to as isopropanol, can function as another inert ingredient. Preferably, the inert carrier composition is a solution of these two components with the compositional range for the mixed xylene isomers varying from 30 to 70 weight percent and with the compositional range of the isopropanol varying from 70 to 30 weight percent. The most preferred composition for this inert carrier is 60 weight percent mixed xylenes and 40 weight percent isopropanol.

In addition to the inert carrier component, the stability-inducing additive package typically contains active components of three different compound classes, namely, antioxidants, metal deactivators (often referred to as metal ion sequesterants) and corrosion inhibitors.

This invention uses a combination of N,N'-dialkyl-p-phenylene diamine and poly-butylated phenols to provide the antioxidant functionality in the stability-inducing additive package. This combination has been found to provide good oxidation stability for virtually all hydrocarbon fuels, including motor gasoline. The preferred oxidation stabilizers have been determined to be N,N'-di-sec-butyl-p-phenylene diamine and 2,6-di-t-butyl phenol. Lesser amounts of other isomers of the 2,6-di-t-butyl phenol can also be present without impeding the efficacy of the components. The stability-inducing additive package typically contains 4 to 22 weight percent of the N,N'-di-sec-butyl-p-phenylene diamine and 1.5 to 12 weight percent of the butylated phenols. The preferred composition of the stability-inducing additive package contains 7.3 weight percent N,N'-di-sec-butyl-p-phenylene diamine and 2.8 weight percent 2,6-di-t-butyl phenol with 0.9 weight percent other isomers of this phenol.

The metal inactivation (metal ion sequestering) functionality of the stability-inducing additive package of the present invention is provided by N,N'-bis-salicyclidene-1,2-propane diamine. Typically this component can be utilized in the practice of this invention in the 5 to 30 weight percent range. Preferably, this component is utilized at the 9.8 weight percentage level in the additive package to be added to a fuel.

As opposed to the current practice of using carboxylic acid corrosion inhibitors in stability-inducing additive packages, this invention employs a strongly basic (i.e., caustic) component as the corrosion inhibitor. Likewise, the corrosion inhibitor of this invention is hydrophobic and, hence, organophilic. This allows any subsequent material formed by the corrosion inhibitor to remain soluble in the hydrocarbon fuel precluding the deposition of undesirable solid materials in the various storage vessels and other pieces of apparatus exposed to the treated fuel.

The strongly basic, organophilic characteristics of the corrosion inhibitor are exhibited by selected organo-amines, specifically those characterized by $pK_b$ values of 4.0 and less, with $pK_b$ being the negative logarithm of their basic dissociation constants in aqueous solution. As is well know in the art, the chemical interaction of a strong base, B, with water in an aqueous solution can be depicted by the following reaction:

$$B + H_2O \dashrightarrow BH^+ + OH^-$$

The basic dissociation constant, Kb, can then be defined by the expression:

$$K_b = \frac{[BH^+][OH^-]}{[B]}$$

Compounds applicable in this invention with these properties include substituted amidines of generalized formulation

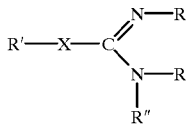

where

R = —H or $[—(CH_2—CH_2)—]_{1/2}$

X = $—CH_2—$ or —NH—

R' = a hydrocarbon radical containing at least 11 and no more than 24 carbon atoms, and R" = —H, an alkyl hydrocarbon radical containing no more than 5 carbon atoms, or a hydroxyalkyl hydrocarbon radical containing no more than 5 carbon atoms.

Members of this family which are preferred compounds for providing corrosion inhibition in this invention are:

Imizolines

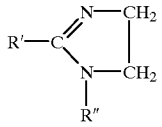

where

R' = a hydrocarbon radical containing at least 11 and no more than 24 carbon atoms, and R" = —H, an alkyl hydrocarbon radical containing no more than 5 carbon atoms, or a hydroxyalkyl hydrocarbon radical containing no more than 5 carbon atoms;

Amidines

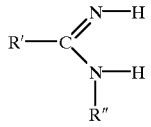

where

R' = a hydrocarbon radical containing at least 11 and no more than 24 carbon atoms, and R" = —H, an alkyl hydrocarbon radical containing no more than 5 carbon atoms, or a hydroxyalkyl hydrocarbon radical containing no more than 5 carbon atoms;

and

Guanidines

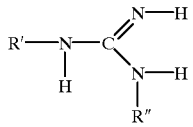

where

R' = a hydrocarbon radical containing at least 11 and no more than 24 carbon atoms, and R" = —H, an alkyl hydrocarbon radical containing no more than 5 carbon atoms, or a hydroxyalkyl hydrocarbon radical containing no more than 5 carbon atoms.

Most preferably, this invention is practiced using a high molecular weight imidazoline, specifically, 2-(8-heptadecyl)-4,5-dihydro-1H-imidazole-1-ethanol, as the corrosion inhibitor. This imidazoline is sold commercially as Amine O® by CIBA-GEIGY and is preferably included in the stability-enhancing additive package in the concentration range of 2 weight percent to 15 weight percent. Most preferably this amine is utilized in the additive package at the 5.2 weight percent level.

The most-preferred embodiment of the stability-enhancing package of this invention is summarized as follows:

| COMPONENT | WEIGHT PERCENTAGE |
|---|---|
| N,N'-di-sec-butyl-p-phenylene diamine | 7.3 |
| 2,6-di-t-butyl phenol | 2.8 |
| other phenols | 0.9 |
| N,N'-bis-salicylidene-1,2-propane diamine | 9.8 |
| Amine O ® | 5.2 |
| Xylene | 44.0 |
| 2-propanol | 30.0 |
| TOTAL | 100.0 |

This mixture is added to commercial gasoline at the rate of 0.5 gallons per 1000 gallons of gasoline to give a highly stabilized gasoline.

What is claimed is:

1. A stability-enhancing additive package for a hydrocarbon fuel consisting essentially of:

| | |
|---|---|
| N,N'-di-sec-butyl-p-phenylene diamine | 7.3 wt % |
| 2,6-di-t-butyl phenol | 2.8 wt % |
| N,N'-bis-daclicylidene-1,2-propane diamine | 9.8 wt % |
| 2-(8-Heptadecenyl)-4,5-dihydro-1H-imidazole-1-ethanol | 5.2 wt % |
| Xylene | 44.0 wt % |
| 2-Propanol | 30.0 wt %. |

2. A stabilized hydrocarbon fuel comprising a hydrocarbon fuel and a stability-inducing additive package, wherein the stability-inducing additive package consists essentially of:

| | |
|---|---|
| N,N'-di-sec-butyl-p-phenylene diamine | 7.3 wt % |
| 2,6-di-t-butyl phenol | 2.8 wt % |
| N,N'-bis-saclicylidene-1,2-propane diamine | 9.8 wt % |
| 2-(8-Heptadecenyl)-4,5-dihydro-1H-imidazole-1-ethanol | 5.2 wt % |
| Xylene | 44.0 wt % |
| 2-Propanol | 30.0 wt %. |

and the additive package is present in the range from 0.25 gallon to 1.0 gallon per 1000 gallons of the hydrocarbon fuel.

3. A stability-inducing additive package for a hydrocarbon fuel comprising:

(a) a metal ion sequesterant which is selected from the group consisting of salicylidene diamines;

(b) a phenylene diamine antioxidant which is selected from the group consisting of N,N'-dialkyl-p-phenylene diamines;

(c) a phenol antioxidant which is selected from the group consisting of butylated phenols; and (d) a hydrophobic amine corrosion inhibitor which has a $pK_b$ equal to or less than 4.0 and is selected from the group consisting of compounds of the formula:

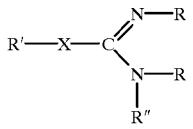

where

R = H or both R are joined together and together =—($CH_2$—$CH_2$)—,

X = —$CH_2$— or —NH—,

R' = a hydrocarbon radical containing 11 to 24 carbon atoms, and

R" = H, an alkyl hydrocarbon radical containing no more than 5 carbon atoms, or a hydroxyalkyl hydrocarbon radical containing no more than 5 carbon atoms;

wherein said metal ion sequesterant, antioxidants, and corrosion inhibitor are present in the additive package at a concentration which is effective to provide the fuel with enhanced stability toward oxidation and solid deposit formation during storage when said fuel is blended with the additive package.

4. The additive package of claim 3 wherein said fuel is motor gasoline.

5. The additive package of claim 3 wherein from 0.25 gallon to 1.0 gallon of the additive package is blended with 1000 gallons of fuel.

6. The additive package of claim 3 wherein the metal ion sequesterant is N,N'-bis-salicyclidene-1,2-propane diamine and the additive package contains from 5 to 30 weight percent of said metal ion sequesterant.

7. The additive package of claim 3 wherein the corrosion inhibitor comprises an imidazoline.

8. The additive package of claim 7 wherein the corrosion inhibitor is comprised of 2-(8-heptadecenyl)-4,5-dihydro-1H-imidazole-1-ethanol and the additive package contains from 2 to 15 weight percent of 2-(8-heptadecenyl)-4,5-dihydro-1H-imidazole-1-ethanol.

9. The additive package of claim 3 wherein the phenylene diamine antioxidant is comprised of N,N'-di-sec-butyl-p-phenylene diamine.

10. The additive package of claim 9 wherein the phenol antioxidant is selected from the group consisting of 2,6-di-t-butyl phenol and its isomers.

11. The additive package of claim 9 wherein the additive package contains from 4 to 22 weight percent of N,N'-di-sec-butyl-p-phenylene diamine and from 1.5 to 12 weight percent of the phenol antioxidant.

12. The additive package of claim 3 which additionally comprises from about 22 to 87 weight percent of inert solvent.

13. The additive package of claim 12 wherein said solvent comprises a mixture of at least one aromatic hydrocarbon and at least one alcohol.

14. The additive package of claim 13 wherein said aromatic hydrocarbon is selected from the group consisting of xylene and its isomers, and said alcohol is 2-propanol.

15. A stability-inducing additive package for a hydrocarbon fuel comprising:

(a) a metal ion sequesterant which is selected from the group consisting of salicylidene diamines;

(b) a phenylene diamine antioxidant which is selected from the group consisting of N,N'-dialkyl-p-phenylene diamines;

(c) a phenol antioxidant which is selected from the group consisting of butylated phenols; and (d) a hydrophobic amine corrosion inhibitor which has a $pK_b$ equal to or less than 4.0 and is selected from the group consisting of amidines of formula I and guanidines of formula II:

(I)

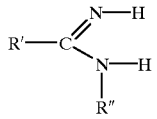

(II)

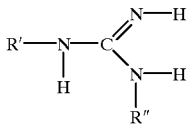

where

R' = a hydrocarbon radical containing at least 11 and no more than 24 carbon atoms, and R" = H, an alkyl hydrocarbon radical containing no more than 5 carbon atoms, or a hydroxyalkyl hydrocarbon radical containing no more than 5 carbon atoms;

wherein said metal ion sequesterant, antioxidants, and corrosion inhibitor are present in the additive package at a concentration which is effective to provide the fuel with enhanced stability toward oxidation and solid deposit formation during storage when said fuel is blended with the additive package.

16. A stability-inducing additive package for a hydrocarbon fuel comprising:

(a) from 5 to 30 weight percent of N,N'-bis-salicyclidene-1,2-propane diamine;

(b) from 4 to 22 weight percent of N,N'-di-sec-butyl-p-phenylene diamine;

(c) from 1.5 to 12 weight percent of butylated phenols which are selected from the group consisting of 2,6-di-t-butyl phenol and its isomers;

(d) from 2 to 15 weight percent of 2-(8-heptadecyl)-4,5-dihydro-1H-imidazole-1-ethanol; and (e) from 22 to 87 weight percent of a solvent which is comprised of a mixture of at least one aromatic hydrocarbon and at least one alcohol.

17. The additive package of claim 16 wherein the aromatic hydrocarbon of the solvent mixture is selected from the group consisting of xylene and its isomers, the alcohol of the solvent mixture is 2-propanol, and the amount of 2-propanol in the solvent mixture is from 30 to 70 weight percent.

18. A method for enhancing the stability of a hydrocarbon fuel which comprises adding the following components to said fuel:

(a) a metal ion sequesterant which is selected from the group consisting of salicylidene diamines;

(b) a phenylene diamine antioxidant which is selected from the group consisting of N,N'-dialkyl-p-phenylene diamines;

(c) a phenol antioxidant which is selected from the group consisting of butylated phenols; and (d) a hydrophobic amine corrosion inhibitor which has a $pK_b$ equal to or less than 4.0 and is selected from the group consisting of compounds the formula:

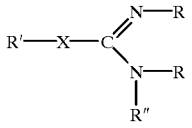

where

R = H or both R are joined together and together =—($CH_2$—$CH_2$)—,

X = —$CH_2$— or —NH—,

R' = a hydrocarbon radical containing 11 to 24 carbon atoms, and

R" = H, an alkyl hydrocarbon radical containing no more than 5 carbon atoms, or a hydroxyalkyl hydrocarbon radical containing no more than 5 carbon atoms;

wherein the amount of said metal ion sequesterant is effective to sequester contaminant metal ions, wherein the amount of said antioxidants is effective to enhance the oxidative stability of the fuel, and wherein the amount of said corrosion inhibitor is effective to provide the fuel with corrosion inhibiting properties and to inhibit the precipitation of contaminant carboxylate salts from the fuel.

19. The method of claim 18 wherein the hydrocarbon fuel is motor gasoline.

20. The method of claim 18 wherein the corrosion inhibitor is comprised of an imidazoline.

21. The method of claim 20 wherein the corrosion inhibitor is comprised of 2-(8-heptadecenyl)-4,5-dihydro-1H-imidazole-1-ethanol.

22. The method of claim 18 wherein the phenylene diamine antioxidant is comprised of N,N'-di-sec-butyl-p-phenylene diamine.

23. The method of claim 22 wherein the phenol antioxidant is selected from the group consisting of 2,6-di-t-butyl phenol and its isomers.

24. A method for enhancing the stability of a hydrocarbon fuel which comprises adding the following components to said fuel:

(a) a metal ion sequesterant which is selected from the group consisting of salicylidene diamines;

(b) a phenylene diamine antioxidant which is selected from the group consisting of N,N'-dialkyl-p-phenylene diamines;

(c) a phenol antioxidant which is selected from the group consisting of butylated phenols; and (d) a hydrophobic amine corrosion inhibitor which has a $pK_b$ equal to or less than 4.0 and is selected from the group consisting of amidines of formula I and guanidines of formula II:

(I)

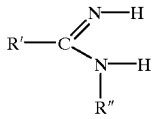

-continued (II)

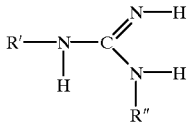

where

R' = a hydrocarbon radical containing at least 11 and no more than 24 carbon atoms, and R" = H, an alkyl hydrocarbon radical containing no more than 5 carbon atoms, or a hydroxyalkyl hydrocarbon radical containing no more than 5 carbon atoms;

wherein the amount of said metal ion sequesterant is effective to sequester contaminant metal ions, wherein the amount of said antioxidants is effective to enhance the oxidative stability of the fuel, and wherein the amount of said corrosion inhibitor is effective to provide the fuel with corrosion inhibiting properties and to inhibit the precipitation of contaminant carboxylate salts from the fuel.

25. A stabilized hydrocarbon fuel which comprises a mixture of a hydrocarbon fuel with a stability-inducing additive package, said additive package comprising:

(a) a metal ion sequesterant which is selected from the group consisting of salicylidene diamines;

(b) a phenylene diamine antioxidant which is selected from the group consisting of N,N'-dialkyl-p-phenylene diamines;

(c) a phenol antioxidant which is selected from the group consisting of butylated phenols; and (d) a hydrophobic amine corrosion inhibitor which has a $pK_b$ equal to or less than 4.0 and is selected from the group consisting of compounds the formula:

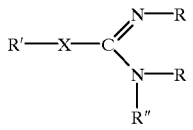

where

R = H or both R are joined together and together =—($CH_2$—$CH_2$)—,

X = —$CH_2$— or —NH—,

R' = a hydrocarbon radical containing 11 to 24 carbon atoms, and

R" = H, an alkyl hydrocarbon radical containing no more than 5 carbon atoms, or a hydroxyalkyl hydrocarbon radical containing no more than 5 carbon atoms;

wherein the amount of said metal ion sequesterant is effective to sequester contaminant metal ions, wherein the amount of said antioxidants is effective to enhance the oxidative stability of the fuel, and wherein the amount of said corrosion inhibitor is effective to provide the fuel with corrosion inhibiting properties and to inhibit the precipitation of contaminant carboxylate salts from the fuel.

26. The stabilized hydrocarbon fuel of claim 25 wherein said fuel is motor gasoline.

* * * * *

UNITED STATES PATENT AND TRADEMARK OFFICE

CERTIFICATE OF CORRECTION

PATENT NO. : 6,083,288
DATED : July 4, 2000
INVENTOR(S) : Leslie R. Wolf

It is certified that error appears in the above-identified patent and that said Letters Patent is hereby corrected as shown below:

Column 1,
Line 12, "In one aspect it relates" should read -- In one aspect, it relates --.
Line 14, "In another aspect it relates" should read -- In another aspect, it relates --.

Column 2,
Line 58, "is precluded eliminating" should read -- is precluded, eliminating --.

Column 3,
Lines 6 and 7, "are immediately converted" should read -- is immediately converted --.
Lines 10 and 11, "a N,N'-dialkyl-p-phenylene" should read -- an N,N'-dialkyl-p-phenylene --.

Column 4,
Line 30; "a N,N'-bis-salicyclidene" should read -- an N,N'-bis-salicyclidene --.
Line 31, "Typically this component" should read -- Typically, this component --.
Line 50, "As is well know" should read -- As is well known --.

Column 5,
Line 20, "Imizolines" should read -- Imidazolines --.

Column 6,
Line 34, "N,N'-bis-daclicylidene" should read -- N,N'-bis-salicylidene --.
Line 47, "N,N'-bis-saclicylidene" should read -- N,N'-bis-salicylidene --.

Column 7,
Line 30, "N,N'-bis-salicyclidene" should read -- N,N'-bis-salicylidene --.

UNITED STATES PATENT AND TRADEMARK OFFICE

CERTIFICATE OF CORRECTION

PATENT NO. : 6,083,288
DATED : July 4, 2000
INVENTOR(S) : Leslie R. Wolf

It is certified that error appears in the above-identified patent and that said Letters Patent is hereby corrected as shown below:

Column 8,
Line 37, "N,N'-bis-salicyclidene" should read -- N,N'-bis-salicylidene --.

Signed and Sealed this

Second Day of October, 2001

*Attest:*

Nicholas P. Godici

*Attesting Officer*

NICHOLAS P. GODICI
*Acting Director of the United States Patent and Trademark Office*